United States Patent [19]

Huber et al.

[11] 4,329,554

[45] May 11, 1982

[54] LOADBREAK ARC SNUFFING DEVICE

[76] Inventors: William J. Huber, 535 W27560 Country Club Ct.; Todd K. Knapp, W270 53935 Heather Dr., both of Waukesha, Wis. 53186

[21] Appl. No.: 110,350

[22] Filed: Jan. 7, 1980

[51] Int. Cl.[3] ..... H01H 33/06; H01H 9/32

[52] U.S. Cl. ..... 200/151; 200/144 R; 200/144 C; 200/149 A

[58] Field of Search ..... 200/151, 149 R, 149 A, 200/144 R, 144 C

[56] References Cited

U.S. PATENT DOCUMENTS 3,129,307 4/1964 Vargas ..... 200/151

FOREIGN PATENT DOCUMENTS 696687 9/1940 Fed. Rep. of Germany ..... 200/151

*Primary Examiner*—Robert S. Macon

[57] ABSTRACT

An arc snuffing device for use on high voltage circuits during loadbreaking operations, the device including an arc quenching tube biased for movement over an electrical contact and an arc quenching member during a load breaking operation to confine the arc produced on loadbreak to the space between the arc quenching tube and the arc quenching member, the arc quenching tube further defining the direction of flow of the arc quenching gases produced by the arc to produce a partial vacuum in the space where the arc is confined and induce an air blast into the space to quench the arc, the arc quenching tube being automatically reloaded on reclosing of the electrical contacts.

10 Claims, 4 Drawing Figures

LOADBREAK ARC SNUFFING DEVICE

BACKGROUND OF THE INVENTION

The use of arc quenching materials to extinguish arcs either on loadbreak or loadmake operations is well known. Some of these devices work on the principal of movement of the arc quenching material into the proximity of the arc while others move the arc into the proximity of the material. In either case, the direction of gas flow is not controlled nor used for any particular purpose. Most of these devices also require reloading of the device prior to reclosing of the contacts.

SUMMARY OF THE INVENTION

The arc quenching device of the present invention provides control of the direction of flow of the arc quenching materials on loadbreak to produce a partial vacuum in the area of the arc and to thus draw cooling air into the arc space to aid in quenching the arc. The device is self reloading on loadmake and requires no special latching mechanism to hold it in position until loadbreak.

DRAWINGS

DESCRIPTION OF INVENTION

Figure 1:
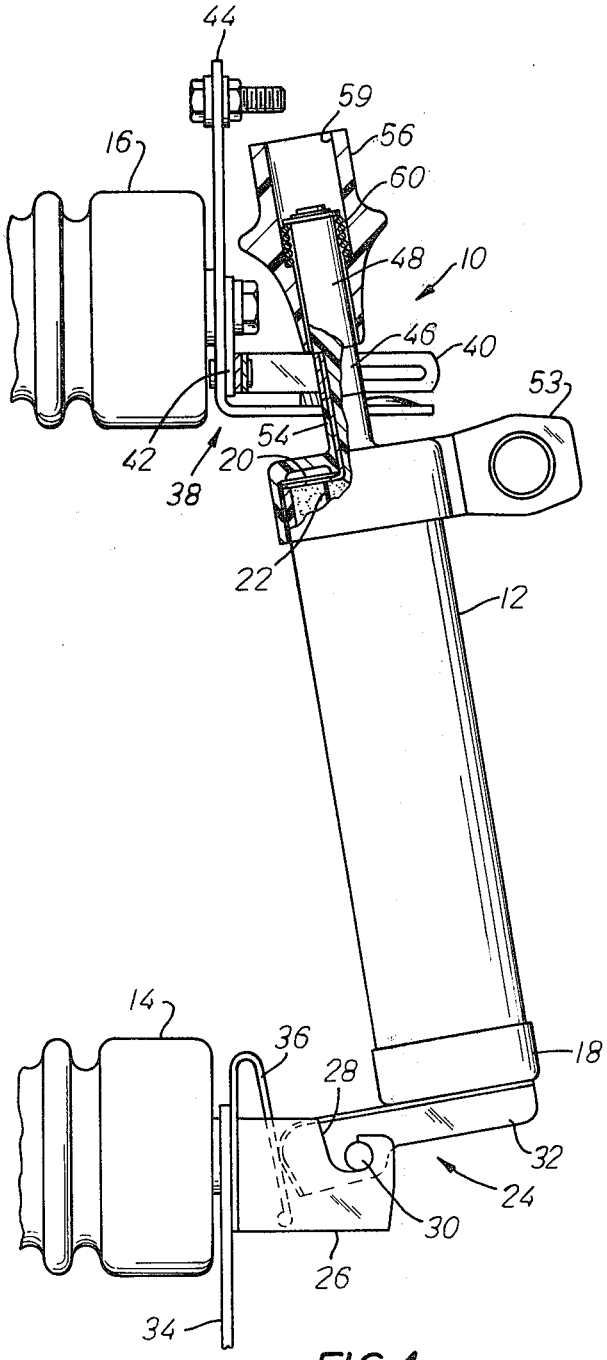
FIG. 1 is a side view in elevation of a current limiting fuse employing the arc snuffing device according to the present invention to extinguish the arc on opening of the fuse contacts.

The arc snuffing device 10 according to the present invention is shown mounted on one end of a current limiting fuse 12. The current limiting fuse being hingedly supported at one end by means of an insulator 14 and at the other end by means of an insulator 16.

In this regard, the current limiting fuse 12 is of the conventional type having an electrically conductive cap 18 at one end and an electric conductive cap 20 at the other end. The electrically conductive caps being connected to fuse elements 22 provided within the fuse.

The fuse 12 is pivotally mounted to the insulator 14 by means of a hinge assembly 24 which includes a pair of fixed supports 26 secured to the insulator 14, each having an arcuate groove 28. A pivot pin 30 is secured to the cap 18 by an electrically conductive support plate 32 and is positioned to pivot in the groove 28. Electrical communication from the cap 18 to the contact 34 is provided by means of a contact spring 36 which engages the end of the plate 32.

The cap 20 is electrically connected to the insulator 16 by means of a fixed contact assembly 38. The contact assembly 38 includes a pair of contacts 40 secured to a plate 42 which is in electrical engagement with a contact plate 44. The cap 20 is connected to the contact elements 40 by means of a contact ring 46 mounted on a dielectric rod 48 and a conductive tube 50 which is in electrical communication with the cap 20 and encircles the dielectric rod 48.

The arc snuffing device includes an arc quenching member 52 which is made from an arc quenching material such as delrin, celcon, rosite, or some other similar material. The member 52 encloses the cap 20 and includes means in the form of a hollow cylindrical portion 54 which surrounds or encloses the exposed surface of the conductive tube 50. The arc quenching portion 54 is in the form of a hollow cylinder which abutts the edge of the conductive ring 46.

Means in the form of an arc extinguishing tube 56 is provided on rod 48 to cooperate with the arc quenching portion 54 to extinguish the arc on load break. In this regard, the tube 56 includes a bore 58 at one end which is slightly larger than the rod 48. The tube 56 is movable into engagement with the cap 52 so that the bore 58 encloses the conductive ring 46 and the cylindrical portion 54. An enlarged bore 59 is provided at the other end of the tube 56 to accommodate the spring 60.

Means are provided for biasing the tube 56 to the closed position. Such means is in the form of a spring 60 provided in the space between the upper end of the rod 48 and the inner surface of the bore 59. The spring is seated on a shoulder 61 provided at the end of the bore 59 in the tube 56. The spring 60 is retained on the end of the tube 48 by means of a washer 62 secured to the rod 48 by a screw 64. The lower end 66 of the arc quenching tube 56 rides on the upper edge of the contacts 40 and therefore has a diameter greater than the distance between the contacts 40.

Means are provided on the cap 52 for opening and closing the fuse 12 with the contacts 40. Such means is in the form of a pull ring 53. The pull ring can be engaged by a hookstick to either open or close the fuse.

Figure 3:
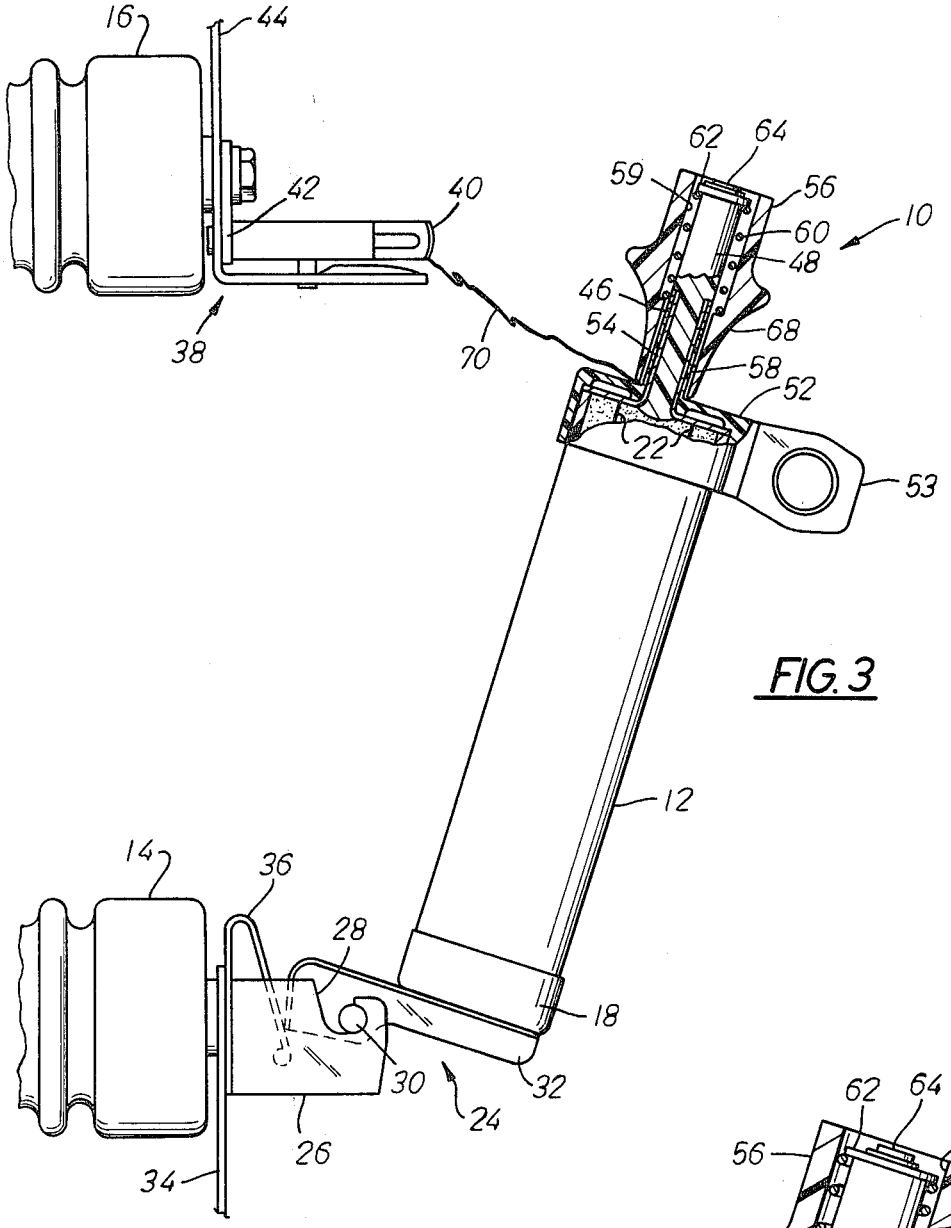
FIG. 3 is a view similar to FIG. 1 showing the fuse in the open position with the arc snuffing device closed.
Figure 4:
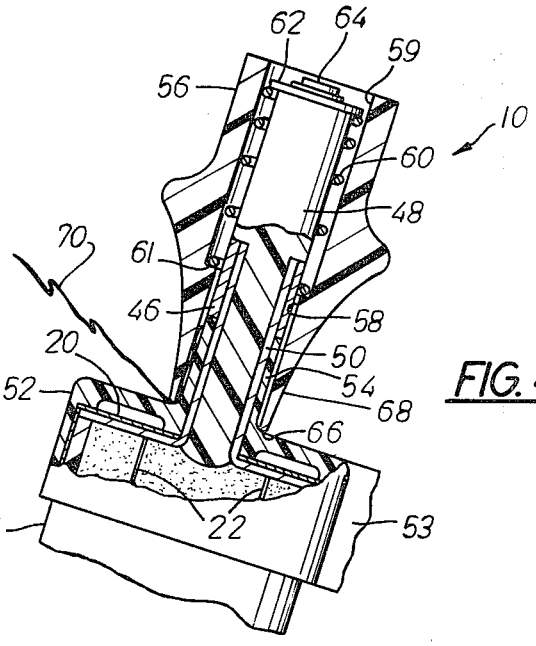
FIG. 4 is an enlarged view of the arc snuffing device shown in the closed position.

When the fuse is moved to the open position as seen in FIG. 3 an arc will be produced as soon as the contact ring 46 clears the end of the contacts 40. Immediately thereafter, the arc quenching tube 56 will move into engagement with the top of the cap 52 to enclose the ring 46 and the arc quenching member 54 within the bore 58 of the tube 56. The arc will then be confined to the space between the inner surface of the bore 58 and the outer surface of the contact ring 46 in arc quenching tube 54.

The heat of the arc will generate an arc extinguishing gas within the space between the tube 56 and the arc quenching tube 54. This gas will vent upward into the enlarged bore 59 in the tube 56 and will pass through the space between the washer 62 and the bore 59 to atmosphere. The direction of flow of the gases and rush of the gases into the bore 59 will create a partial vacuum in the air space around the lower end 66 of the tube. This vacuum will cause cool air to flow into the space between the bore 58 in tube 56 and the arc quenching tube 54 to help cool and quench the arc.

Means are provided for automatic reopening of the arc snuffing device on loadmake or reconnection of the fuse with the contacts 40. Such means is in the form of a camming surface 68 provided on the outer surface of the arc quenching tube 56. On reclosure of the fuse with the contacts 40 the camming surface will cam the tube 56 upward on engagement with the end of the contacts 40.

OPERATION

Figure 2:
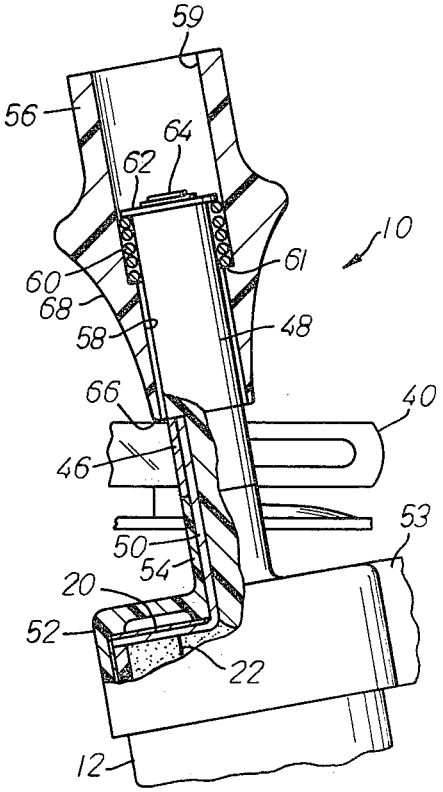
FIG. 2 is an enlarged view of the arc snuffing device partially broken away to show the electrical circuit within the device.

When the fuse 12 is in the closed position, shown in FIGS. 1 and 2, the contact ring 46 will be in engagement with the contacts 40 and current will flow from the ring 46 through the conductive tube 50 to the conductive cap 20 and then through the fuse elements 22 to the conductive cap 18. When the fuse 12 is pulled to the open position as shown in FIG. 3, an arc 70 is drawn between the contact 40 and the contact ring 46. As soon as the contact ring clears the end of the contacts 40, the arc quenching tube 56 will snap down against the cap 52 confining the arc between the inner surface 58 of the tube 56 and the outer surface of the tube 54. The gas generated by the heat of the arc within the space will extinguish the arc.

In the event of fault currents or larger currents being present at the time the fuse is opened, the cloud of gases resulting from the clearing process will contain ionized particles and could result in flashover of the equipment causing the equipment to fail. For example, after the device is pulled open this cloud of gas could cause a flashover to occur between the exposed bottom lip of the conductive cap 20 and the contact 40. If this happened, the arc would not extinguish since it is in an unobstructed air path and would continue to arc and cause damage until a backup device cleared the circuit. The arc snuffer according to the present invention will not allow this to happen because at the larger current magnitudes the gases generated by the arc extinguishing materials are forced up the bore 58 into the enlarged bore 59 in the upper portion of the tube 56. This flow of gases will create a partial vacuum in the lower portion of the bore 58 which will draw air into the bore 58 which helps to cool and deionize the arc.

The embodiments of the invention in which an exclusive property and privilege is claimed are defined as follows:

1. An arc snuffing device for quenching the arc produced on load break from a fixed contact, said device comprising a dielectric rod, an electrically conductive contact located on the rod, said contact being engageable with said fixed contact, a tube formed from an arc quenching material mounted on said rod for axial movement on said rod from a position enclosing said contact to a position exposing said contact, means for biasing said tube to said enclosing contact position, said tube being moved to the open position relative to said contact on movement of said tube into engagement with the fixed contact, whereby said tube will move to the contact enclosing position when said contact is disengaged from said fixed contact to extinguish the arc produced on load break.

2. The device according to claim 1, wherein said biasing means comprises a spring mounted in the space between the dielectric rod and said tube.

3. The device according to claim 1 or 2 wherein said tube includes a cam surface on the outside of said tube for camming said tube to the open position on movement of said contact into engagement with said fixed contact.

4. An arc snuffing device for extinguishing the arc produced on loadbreak of a moveable contact from a fixed contact, said device comprising a dielectric member for supporting the moveable contact, an arc extinguishing means moveably mounted on said member for movement between a first position exposing said contact to a second position enclosing said contact, said arc extinguishing means including a cam surface to cam said arc extinguishing means to the first position on engagement with the fixed contact, a spring means for biasing said arc quenching means to the second position when said moveable contact is disengaged from the fixed contact whereby the arc produced on loadbreak will be extinguished by the movement of the arc extinguishing means to the second position.

5. The arc snuffing device according to claim 4 wherein said dielectric member is the form of a rod and said arc extinguishing means is in the form of a tube.

6. The arc snuffing device according to claim 4 or 5 including an arc extinguishing member secured to said dielectric member in abutting engagement with said moveable contact whereby said arc extinguishing means will enclose said member on movement to said enclosing position to confine the arc produced on interruption in the space between the arc extinguishing means and the arc extinguishing member.

7. The arc snuffing device according to claim 4, 5 or 6 wherein the arc extinguishing means includes means for directing the gases created on loadbreak to flow away from the contact.

8. An arc snuffing device for a loadbreaking current interrupting fuse in a high voltage circuit, said fuse including a housing having an electrically conductive cap at each end interconnected by a fuse element in said housing, one of said caps being hingedly connected to a first contact assembly, said arc snuffing device being connected to the other of said caps for movement into and out of engagement with a second contact assembly, said arc snuffing device including a dielectric rod mounted on said cap, a hollow conductive tube provided on the outer surface of a portion of said dielectric rod and being connected to said conductive cap, a conductive ring provided around the outer surface of the conductive tube in a position to engage the second contact assembly, an arc quenching member enclosing said conductive cap and having a cylindrical portion extending upwardly about the exposed surface of the conductive tube and an arc extinguishing tube mounted on said dielectric tube for movement between an open position wherein said contact ring is exposed to a closed position where said arc extinguishing tube encloses said conductive ring and the outer surface of said cylindrical portion.

9. The arc snuffing device according to claim 5 including means for biasing said arc snuffing tube to a closed position with respect to the conductive ring.

10. The arc snuffing device according to claim 8 or 9 wherein said arc extinguishing tube confines the direction of flow of arc extinguishing gases created by a loadbreak arc to flow thorough said tube away from said cap whereby air on cooling of said gases is drawn into the space between the tube and the arc extinguishing member.

* * * * *

UNITED STATES PATENT AND TRADEMARK OFFICE

CERTIFICATE OF CORRECTION

PATENT NO. : 4,329,554

DATED : May 11, 1982

INVENTOR(S) : William J. Huber and Todd K. Knapp

It is certified that error appears in the above-identified patent and that said Letters Patent is hereby corrected as shown below:

On the title page add /73/ Assignee:
--- RTE Corporation, Waukesha, Wisconsin ---.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*